US005348230A

United States Patent [19]

Mullen et al.

[11] Patent Number: 5,348,230

[45] Date of Patent: Sep. 20, 1994

[54] PLANAR FOAM NOZZLE

[75] Inventors: Timothy L. Mullen, Champlin; Thomas J. Schaefer, Buffalo; Tera D. McCutcheon, Coon Rapids, all of Minn.

[73] Assignee: Graco, Inc., Minneapolis, Minn.

[21] Appl. No.: 15,617

[22] Filed: Feb. 8, 1993

[51] Int. Cl.[5] ..... B05B 7/04

[52] U.S. Cl. ..... 239/428; 239/431

[58] Field of Search ..... 239/431, 415, 524, 428

[56] References Cited

U.S. PATENT DOCUMENTS

| | | | |
|---|---|---|---|
| 1,414,454 | 5/1922 | Brittain | 239/431 |
| 1,423,650 | 7/1922 | Decuir | 239/431 X |
| 2,392,408 | 1/1946 | Radonich | 239/431 X |
| 2,890,836 | 6/1959 | Gusmer et al. | 239/117 |
| 3,920,188 | 11/1975 | Price | 239/403 |
| 4,427,153 | 1/1984 | Schaefer | 239/415 X |
| 4,471,887 | 9/1984 | Decker | 222/135 |
| 4,550,863 | 11/1985 | Farrey | 222/145 |
| 4,568,003 | 2/1986 | Sperry et al. | 222/145 |
| 4,625,916 | 12/1986 | Nieuwkamp et al. | 239/431 |
| 4,688,702 | 8/1987 | Yeames | 222/145 |
| 4,708,292 | 11/1987 | Gammons | 239/414 |
| 4,809,911 | 3/1989 | Ryan | 239/9 |
| 4,867,346 | 9/1989 | Fays et al. | 222/145 |
| 5,104,006 | 4/1992 | Brown | 222/145 |

FOREIGN PATENT DOCUMENTS

| | | | |
|---|---|---|---|
| 278383 | 9/1914 | Fed. Rep. of Germany | 239/431 |

*Primary Examiner*—Andres Kashnikow
*Assistant Examiner*—Kevin P. Weldon
*Attorney, Agent, or Firm*—Douglas B. Farrow

[57] ABSTRACT

A nozzle for use in a foam gun is designed so that the ports for the two materials both enter the flow passage in the same plane. This serves to eliminate lead/lag flow conditions which result in portions of the material being off-ratio. Counterbored or milled slots encircle the angled sealing surface with the slots machined in from alternating edges of the surface communicating with the respective flow passages for the two (or more) materials.

5 Claims, 2 Drawing Sheets

PLANAR FOAM NOZZLE

BACKGROUND OF THE INVENTION

Foam guns have been used for years to produce multiple plural component foams which typically are made up of iso and resin components. Of course, as used herein, the term foam can be understood to refer to any plural component material requiring mixing. Such products have typically suffered from slight conditions of off-ratio resulting from the lead/lag in flow initialization which in turn causes the initial portion of the shot to be iso (or resin depending on the arrangement) rich. This results from the fact that resin and iso components entered the nozzle at different planes.

SUMMARY OF THE INVENTION

It is therefore an object of this invention to provide a foam gun which is capable of on ratio conditions at all times and which may be easily and inexpensively manufactured.

It is also an object of this invention to provide a nozzle which potentially may be retrofitted to existing guns to accomplish the same result.

The instant invention provides an external nozzle shape which makes it possible to produce "same plane? impinger passageways for the two materials while maintaining the seal between them. Counterbored or milled slots encircle the angled sealing surface with the slots machined in from alternating edges of the sealing surface. This arrangement of slots makes it possible to drill impinger holes which intersect with the nozzle ID in the same plane.

The number of the slots and holes and their orientation (position and angle) is dependent upon the particular application. The drawings of the embodiment show 12 slots and 12 holes perpendicular to the nozzle axis however this invention is intended to cover any other possible configuration including an option where there are multiple rows (and planes) of impinger holes, each row having both iso and resin passages.

These and other objects and advantages of the invention will appear more fully from the following description made in conjunction with the accompanying drawings wherein like reference characters refer to the same or similar parts throughout the several views.

DESCRIPTION OF THE PREFERRED EMBODIMENT

Figure 1:
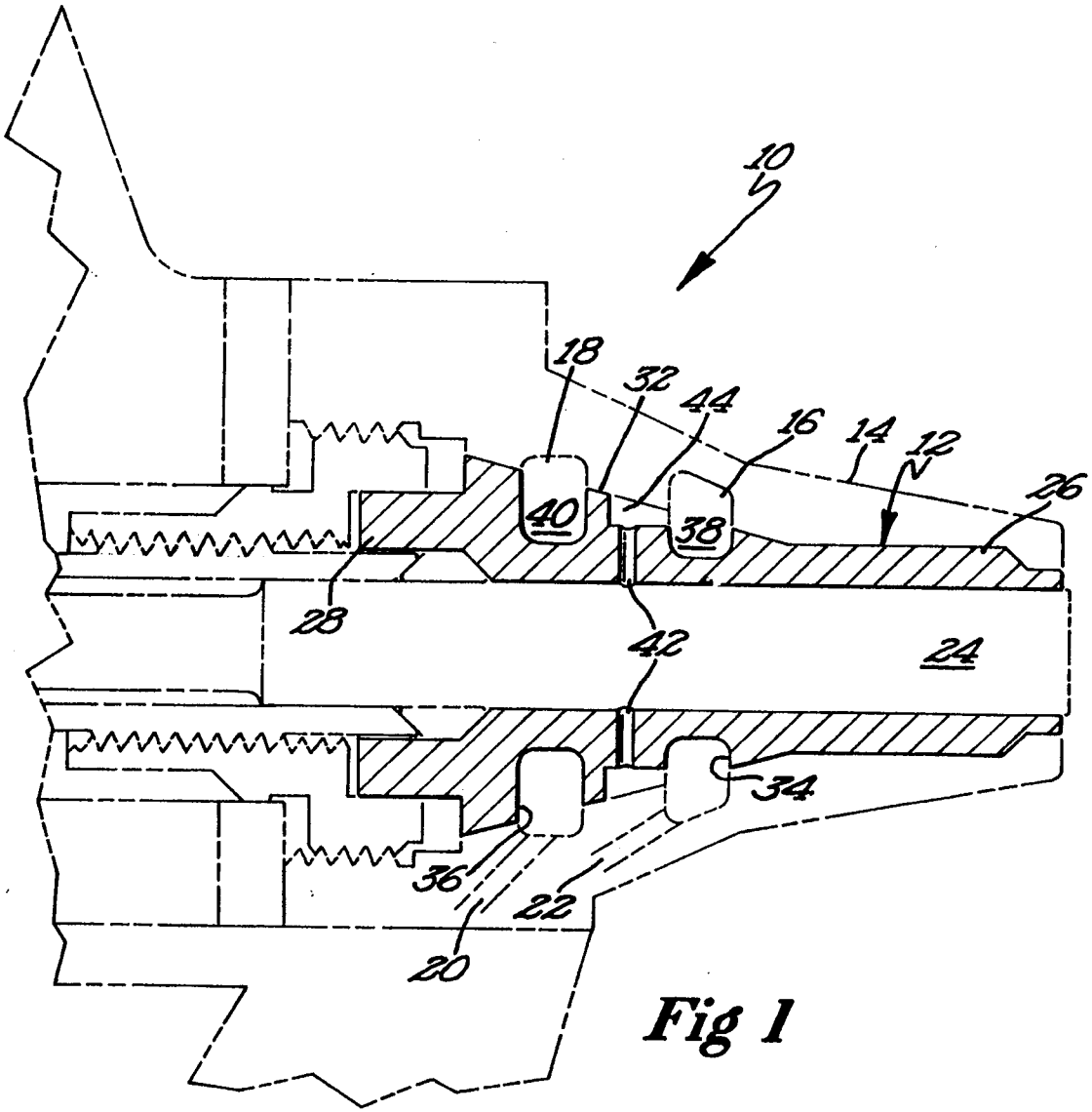
FIG. 1 is a cross-sectional view of the front end of a foam gun utilizing the nozzle of the instant invention.
Figure 3:
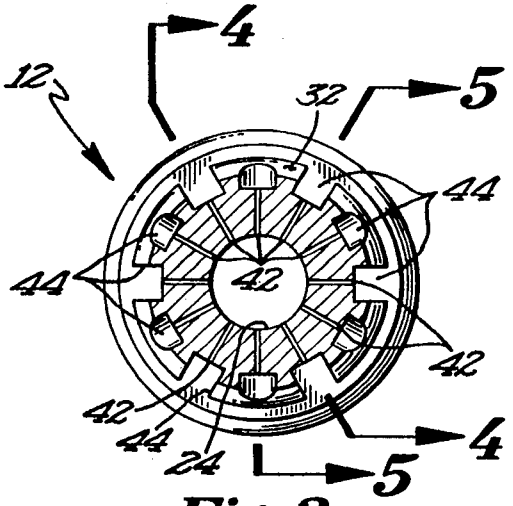
FIG. 3 is a sectional view taken along line 3—3 of FIG. 2.
Figure 5:
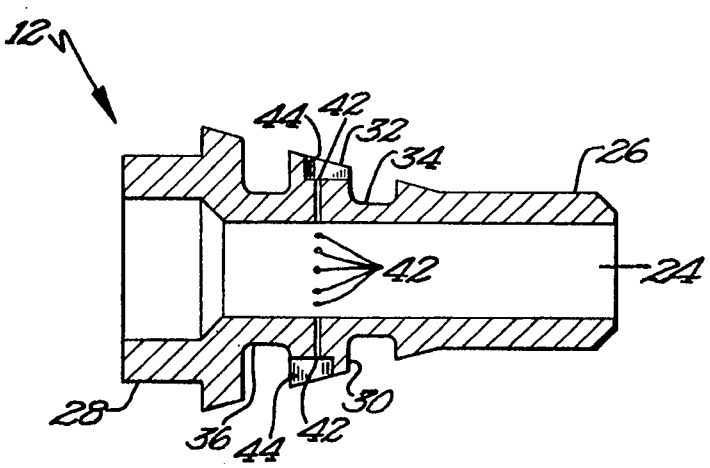
FIG. 5 is a sectional view taken along line 5—5 of FIG. 3.

The device of the instant invention generally designated (10) is comprised of a nozzle (12) which is in the central passage of the front end housing (14) of the foam gun. Housing (14) has first and second material passageways (16 and 18) which are fed by first and second material passages. (20 and 22 respectively).

This general layout is entirely conventional and in fact in the typical prior art design, passages are drilled radially inwardly from the chambers formed by material passages (20 and 22) to central passage (24).

Nozzle (12) includes a central passage (24), a first end (26), a second end (28) and an angled divider (30) having a sealing surface (32). Divider (30) serves to separate first and second slots (34 and 36) which in conjunction with slots (16 and 18) form first and second material chambers (38 and 40 respectively).

Figure 2:
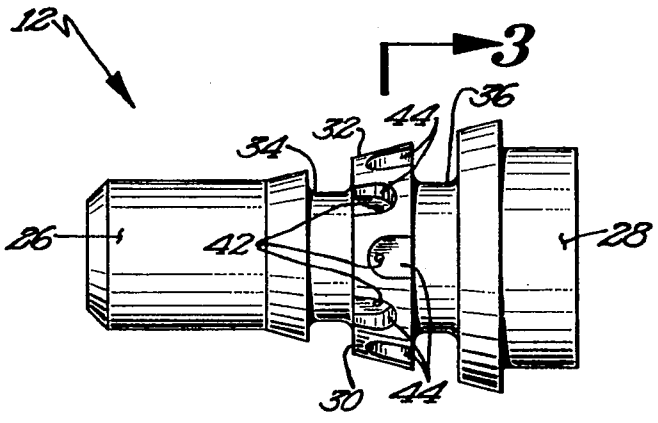
FIG. 2 is a side plan view of the instant invention.
Figure 4:
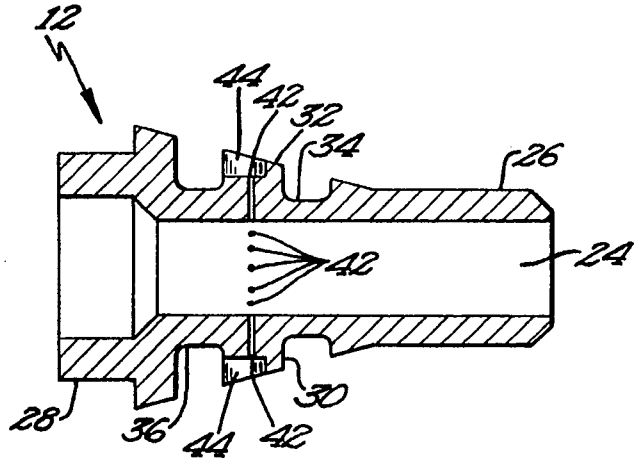
FIG. 4 is a sectional view taken along line 4—4 of FIG. 3.

Impinger passages (42) are drilled radially inwardly from sealing surface (32) to central passage (24) and are spaced about the circumference thereof. Slots (44) are milled in the outer sealing surface (32) of divider (30) and alternately face chambers (38 and 40) as best seen in FIG. 2. In the preferred embodiment, nozzle (12) is formed from a plastic material such as PEEK, however it is appreciated that other suitable materials may be utilized as desired.

While the drawings show twelve impinger ports for purposes of easier understanding, in the preferred embodiment, only four ports are utilized (two iso and two resin). It may also be desired to have ports opposite one another to be of the two different materials if desired.

It is contemplated that various changes and modifications may be made to the nozzle and gun without departing from the spirit and scope of the invention as defined by the following claims.

What is claimed is:

1. A nozzle for use in a foam gun, said foam gun having an axial passage and first and second material passages for receiving first and second reactive materials, said material passages intersecting at axially spaced locations with said axial passage, said nozzle comprising:

a central passage;

a first end;

a second end;

a divider member having a circumference, said divider member and said nozzle first end defining a first material chamber in combination with said axial passage and said divider and said nozzle second end defining a second material chamber in combination with said axial passage, said divider member circumference sealing against said axial passage;

first and second sets of impinger ports extending inwardly from said divider circumference to said central passage; said first and second sets of ports being substantially coplanar to each other; and means connecting said first set of impinger ports to said first material chamber and said second set of ports to said second material chamber, said connecting means comprising recesses in said circumference communicating with said ports and said chambers.

2. The nozzle of claim 1 wherein said impinger ports in said first set alternate with said impinger ports in said second set.

3. The nozzle of claim 1 further comprising at least one additional first and second set of impinger ports in different planes.

4. The nozzle of claim 1 wherein said first and second set of impinger ports extend radially inwardly.

5. The nozzle of claim 1 wherein said nozzle is formed from PEEK.

* * * * *